US005882008A

United States Patent [19]

Siegesmund

[11] Patent Number: 5,882,008

[45] Date of Patent: Mar. 16, 1999

[54] BOARD GAME APPARATUS AND METHOD INVOLVING ANSWERING OBJECTIVE AND SUBJECTIVE QUESTIONS

[76] Inventor: Kenneth A. Siegesmund, 17825 Primrose La., Brookfield, Wis. 53045

[21] Appl. No.: 6,721

[22] Filed: Jan. 14, 1998

Related U.S. Application Data

[60] Provisional application No. 60/035,611 Jan. 17, 1997.

[51] Int. Cl.[6] ..... A63F 3/00

[52] U.S. Cl. ..... 273/249

[58] Field of Search ..... 273/242, 243, 273/248, 249, 429, 430, 431

[56] References Cited

U.S. PATENT DOCUMENTS

| | | | |
|---|---|---|---|
| 3,939,578 | 2/1976 | Coffey | 273/243 |
| 5,257,939 | 11/1993 | Robinson et al. | 273/236 |
| 5,273,431 | 12/1993 | Charouhas | 273/243 |
| 5,295,834 | 3/1994 | Saunders | 273/249 |

FOREIGN PATENT DOCUMENTS

| | | | |
|---|---|---|---|
| 1263126 | 11/1989 | Canada | 273/249 |
| 2198361 | 6/1988 | United Kingdom | 273/249 |

*Primary Examiner*—William E. Stoll

*Attorney, Agent, or Firm*—Andrus, Sceales, Starke & Sawall

[57] ABSTRACT

A board game apparatus including a game board divided into a plurality of playing spaces connecting a starting space with a destination point. The players roll a die and move along the playing spaces accordingly. Upon landing on a playing space, the player has the choice to either answer an objective question or a subjective question in order to continue moving toward the destination point or pass. If the player incorrectly answers a question, he or she must move backward along the path between the starting point and the destination point. The objective cards each include a question and a correct answer, while the subjective cards include a question and two possible answers. The correct answer to a subjective question can be determined either by selecting a pre-determined answer printed on the card based on a poll of the general public or other selected group, or by polling the players.

14 Claims, 3 Drawing Sheets

BOARD GAME APPARATUS AND METHOD INVOLVING ANSWERING OBJECTIVE AND SUBJECTIVE QUESTIONS

CROSS-REFERENCE TO RELATED APPLICATION

This application claims priority to provisional application Ser. No. 60/035,611, filed Jan. 17, 1997.

BACKGROUND AND SUMMARY OF THE INVENTION

This invention relates to games, and more particularly to a board-type game.

The board game apparatus of the present invention includes a game board having a plurality of playing spaces defining a course of travel extending between a starting space and at least one destination point. Each of the playing spaces includes one of a plurality of colored indicia. The board game apparatus further includes a set of objective question cards and a set of subjective question cards. The objective question cards each include an objective question and two possible answers. The correct answer to the objective question is printed on the card.

The subjective question cards each include a subjective question and two possible answers. Since the question on the subjective question card does not have a definite correct answer, the answer can be determined in one of many ways. In a first option, the correct answer is pre-printed on the subjective question card, and is determined by polling a sample of the general public or other group. In a second option, the correct answer is determined by polling the game players and identifying the most popular answer.

When playing the game, the current player rolls a die and moves a corresponding number of playing spaces along the game board. Upon landing on one of the playing spaces, the current player is asked a question from one of the question cards corresponding to the indicia on the playing space. After hearing the question, the current player can either decline to answer the question and remain on the playing space while losing his or her turn or choose to answer the question. If the current player correctly answers the question, he or she receives another turn and rolls the die to move along the gameboard. If the current player incorrectly answers the question, he or she moves backward three playing spaces and loses his or her turn. The current player can only advance along the gameboard by correctly answering a question.

Upon reaching either of the destination points, the current player must answer a question from the question card corresponding to the indicia on the destination point. The first of the players to correctly answer a question during his or her turn while on one the destination points is deemed the winner.

The objective question cards and the subjective question cards can each contain questions from a variety of distinct categories, such that the subject matter of the questions can be varied. Since each of the objective and subjective question cards includes only two answers to select from, the board game of the present invention does not require either a de novo answer or a stressful decision in comparing a large number of possible answers.

Other features and advantages of the invention may be apparent to those skilled in the art upon inspecting the following drawings and description thereof.

BRIEF DESCRIPTION OF THE DRAWINGS

The drawings illustrate the best mode presently contemplated of carrying out the invention.

In the drawings.

DETAILED DESCRIPTION OF THE DRAWINGS

Figure 1:
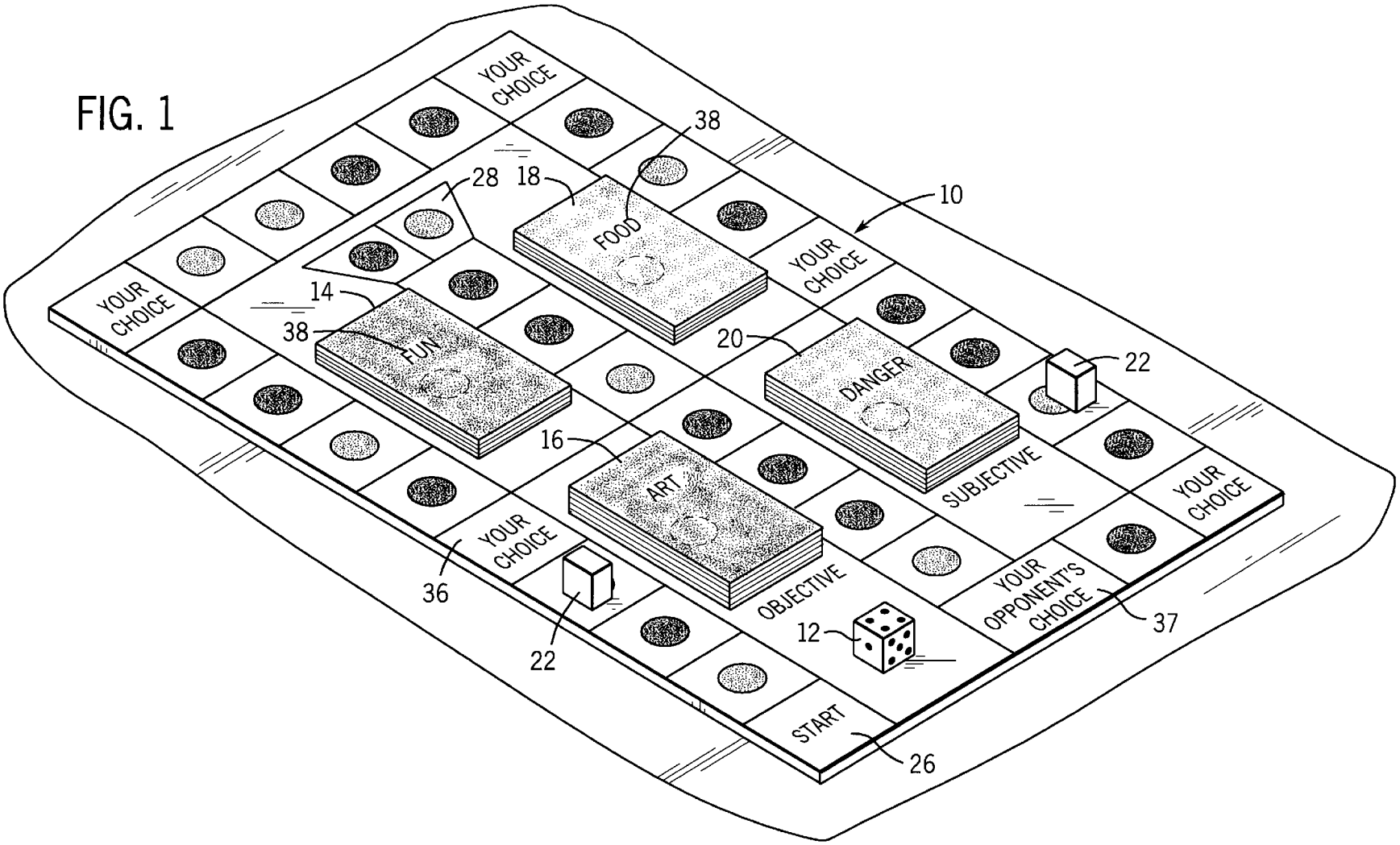
FIG. 1 is a view illustrating the various components of the board game apparatus of the invention, including the game board, the die, the objective question cards, the subjective question cards, and the playing members.

FIG. 1 generally illustrates the components of the board game apparatus of the invention, which include a game board 10, a die 12, a first set or deck of objective question cards 14, a second set or deck of objective question cards 16, a first set or deck of subjective question cards 18, a second set or deck of subjective question cards 20, and a series of playing members 22. Although the playing members 22 are shown as being simply block-shaped pieces, the configuration of each playing member 22 could take a variety of forms or shapes.

Figure 2:
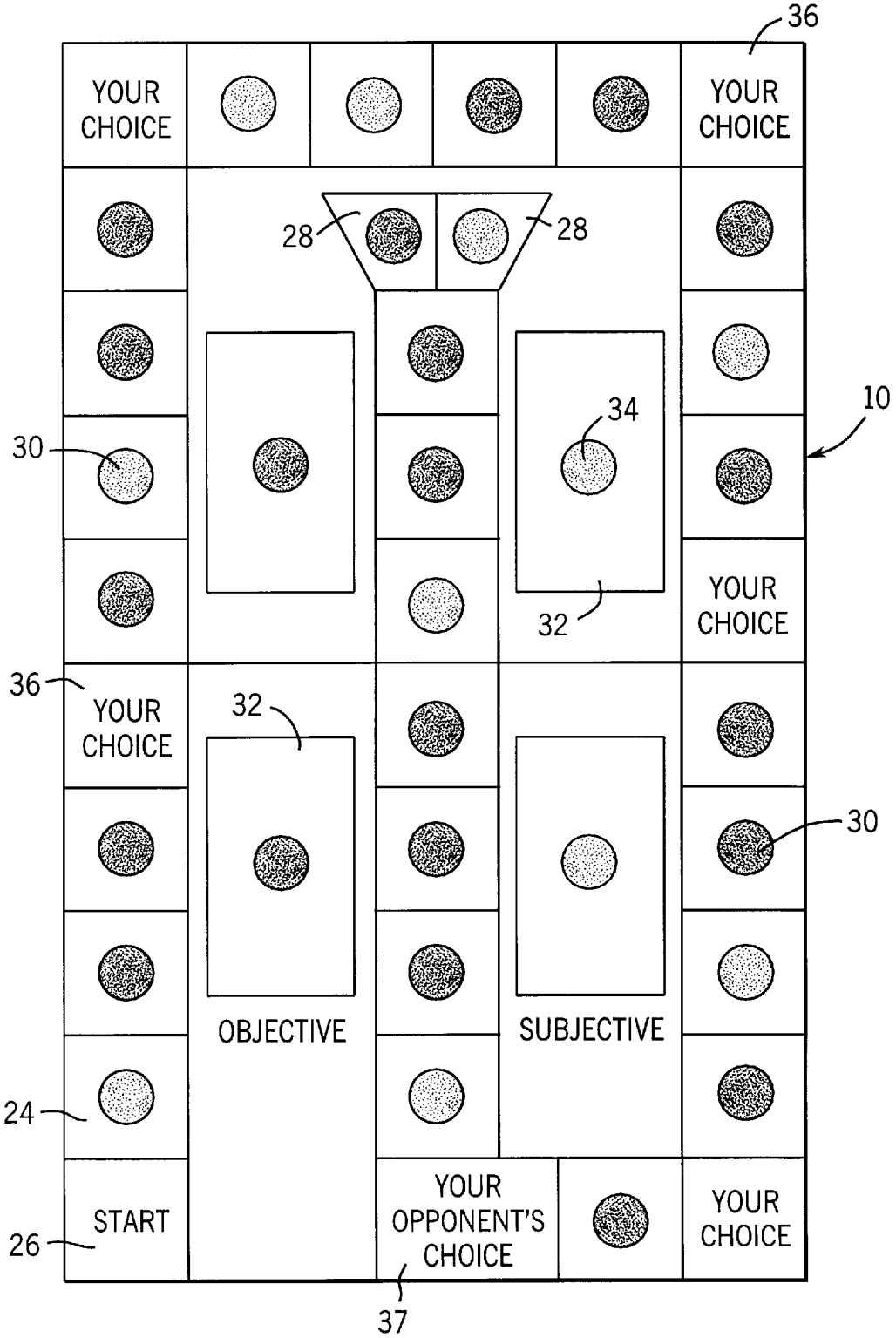
FIG. 2 is a plan view showing the layout of the game board.
Figure 3:
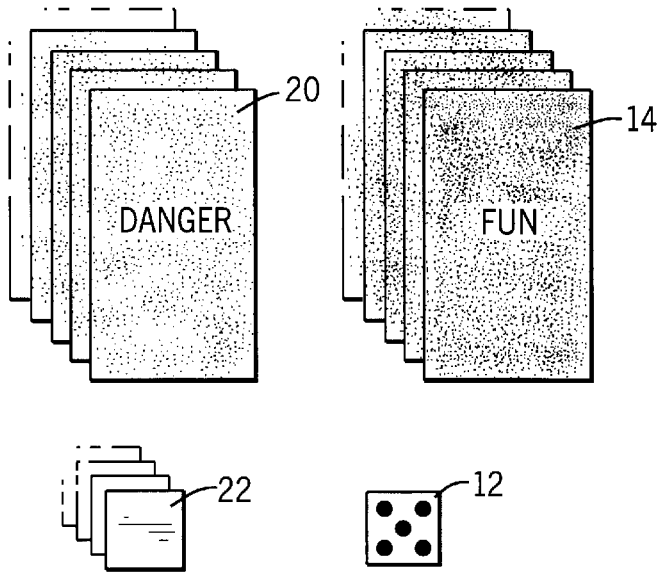
FIG. 3 is a view showing a set of subjective question cards, a set of objective question cards, the playing members, and the die.

Referring now to FIG. 2, the game board 10 generally includes a plurality of playing spaces 24 aligned to form a continuous path between a starting space 26 and a pair of destination points 28. The series of playing spaces 24 define a course of travel to be followed by the players between the starting space 26 and the destination points 28. Each of the playing spaces 24 includes an indicia 30. In the preferred embodiment of the invention, the indicia 30 are circles having one of two distinct colors. The game board 10 further includes four card position indicators 32 that provide guidance for the correct placement of the decks of question cards on the gameboard 10. Each of the card position indicators 32 includes an indicia 34 corresponding to one of the two distinct colors selected for the indicia 30 such that each of the card position indicators 32 is identified by one of the two selected colors. The colors of the indicia 34 also correspond to the colors of the question cards 14, 16, 18 and 20 such that the question cards can be positioned on the correct card position indicator 32 based on color.

In addition to the playing spaces 24, the course of travel between the starting space 26 and the destination points 28 includes several choice spaces 36 and 37. When a player lands on either type of choice space 36 or 37, the written instructions in the choice space 36 or 37 instruct either the player or the player's opponent to select a card from one of the question card decks.

Figure 4:
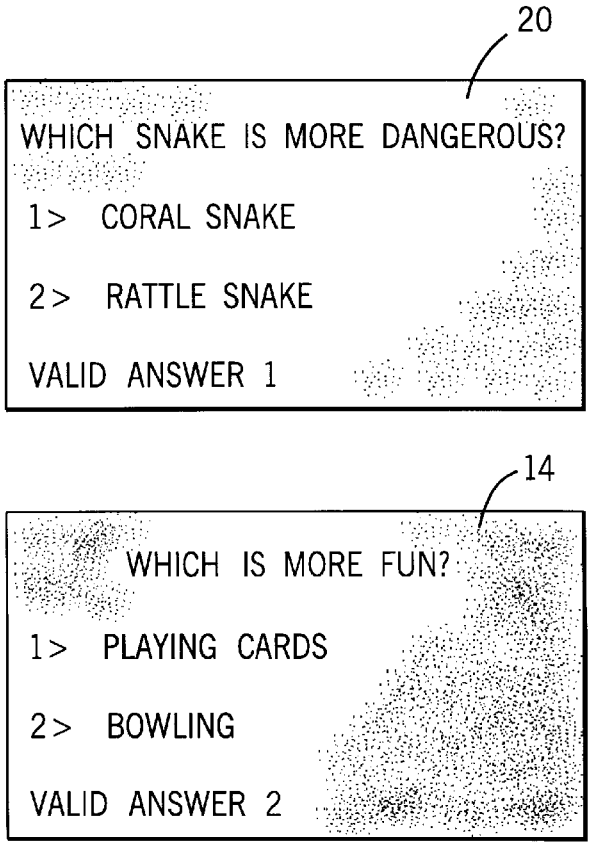
FIG. 4 is a view showing a sample of both an objective question card and a subjective question card.

FIG. 4 depicts representative cards from the deck of objective question cards 14 and subjective question cards 20. As shown in FIG. 1, the supply of objective question cards are separated into two decks 14 and 16, such that two objective question cards are always displayed at any time. As FIG. 1 indicates, each of the objective question cards includes a label 38 that indicates the general category of question contained on the card. As shown in FIG. 1, the top card of the first set of objective question cards 14 pertains to the general category of "fun" as indicated by label 38, while the top card of the second set of objective question cards 16 generally pertains to the category of art. The supply of objective question cards that is split into the two decks 14 and 16 generally include a large number of categories, e.g. 100 to 500, or more, as indicated on the top face of the card by label 38. As presented at any one time, however, only two categories are available for selection. Additionally, the objective questions cards are all the same color such that they correspond in color to one of the two distinct colors selected for the indicia 34.

Each of the objective question cards contained in decks 14 and 16 generally includes an objective question, two possible answers, and the correct answer indicated on the card as shown in FIG. 4. Since the question is objective, one of the two provided answers will be correct. Sample objective question cards in addition to the one shown in FIG. 4 are set out below:

| Which is larger? | What TV show is more recent? |
|---|---|
| 1) Mars | 1) I Love Lucy |
| 2) Venus | 2) The Partridge Family |
| Valid Answer #2. | Valid Answer #2. |

The supply of subjective question cards, which are divided into the decks 18 and 20, each include a label 38 that identifies the general category of the question contained on the individual card. As with the objective question cards, the subjective question cards contain questions from a large number of unrelated categories, e.g. 100 to 500 or more, as indicated on the top face of each card. By dividing the subjective question cards into two separate decks 18 and 20, two subjective question cards will always be displayed at any one time. As shown in FIG. 1, the top card of the first set of subjective question cards 18 pertains to the general category of "food", while the top card of the second set of subjective question cards 20 generally pertains to the category of "danger". All of the subjective question cards have the same color such that they correspond in color to one of the indicia 30.

Each of the subjective question cards includes a subjective question along with two possible answers as shown in FIG. 4. Since each subjective question card includes a subjective question, there is no definite correct answer. Rather, the correct answer can be based on either the most popular answer given in a representative poll of the general population or some other selected group, which is imprinted on the card, or the answer can be determined by polling the individual players and determining the most selected answer. If a poll is taken of the individual players playing the game, the player being asked the question must respond to the question prior to the poll of the other individual players being taken. Sample subjective question cards in addition to the one shown in FIG. 4 are set out below:

| Who is prettier? | Who is dumber? |
|---|---|
| 1) Helen of Troy | 1) Our President |
| 2) Cleopatra | 2) Our Vice President |
| Subjective marjority answer #1. | Subjective marjority answer #2. |

The rules and play of the board game apparatus illustrated in FIGS. 1–4 will now be explained.

Object

The object of the board game of the invention is to be the first player to travel from the starting space 26 to one of the destination points 28 while traveling along the path defined by the individual playing spaces 24 and choice spaces 36 and 37.

Set-Up

Prior to commencing play, the players each select one of the playing members 22 to represent themselves along the course of travel between the starting space 26 and the destination points 28. In the preferred embodiment of the invention, the playing members 22 are either of different shapes or colors, such that the players can differentiate themselves on the game board 10. After assigning one of the playing members 22 to each player, the players then divide the supply of objective question cards and the subjective question cards into two decks each and place the decks on the card position indicators 32 on the game board 10 based on the indicia 34.

Playing The Game

The players roll die 12 to determine which player goes first, with the player rolling the highest number going first. Once the order of play has been determined, the first player rolls the die 12 to determine the number of playing spaces 24 he or she should advance from the starting space 26. Upon advancing the number of playing spaces 24 shown by the die 12, one of the opposing players selects the top card from one of the two decks of cards having the same color as the indicia 30 contained in the playing space 24 upon which the current player's playing member 22 lands. Since each of the question cards includes a label 38 on the top face of the card that identifies the category of the question contained on the card, the current player is able to determine the category of the question the current player must answer. If the current player lands on one of the choice spaces 36, the current player can then choose between objective or subjective cards, and from which category the question card is to be drawn. Likewise, if the current player lands on one of the choice spaces 37, the player's opponent can choose between objective or subjective cards, and from which category the question card is to be drawn.

After one of the question cards has been selected, one of the opposing players reads the question to the current player. If one of the objective question cards from decks 14 or 16 has been selected, the opposing player simply reads the question and waits for a decision from the current player. The current player can either decline to answer the question and remain on the current playing space while losing his or her turn, or elect to answer the question. If the current player answer the question correctly, he or she can roll the die 12 again and continue to advance along the game board 10. However, if the current player answers the question incorrectly, he or she must move backward three spaces and loses his or her turn.

If the question being asked of the current player is from one of the two decks of subjective question cards 18 or 20, one of two playing options can be selected. The playing option to be used when dealing with the subjective question cards is determined by the players prior to beginning play and is then used for the duration of the game. In the first option, the current player is asked the question from the subjective question card 18 or 20 and is asked to either answer or pass. A pre-determined answer, based on the most popular response from a poll of the general public or from some other selected, defined group, is printed on the card, such that the answer of the current player can be judged based on the answer derived from such a poll. If the current player answers correctly, the current player can then roll the die 12 again and advance along the game board 10. If incorrect, the current player must move backward three spaces.

In the second option, the current player is asked a question from one of the decks of subjective question cards 18 or 20 and elects to respond or pass. However, in the second option, the correct answer is determined by polling the opposing players and deriving an answer based on the majority of the answers given by the opposing players. If the answer given by the current player is the same as the most popular answer given by the opposing players, the current player can again roll the die 12 and proceed along the game board 10. However, if the current player does not answer the question correctly, he or she must move backward three spaces.

As the player advances along the game board 10 from the starting space 26 toward destination points 28, the player can select either destination point 28 for the final question. One of the destination points 28 corresponds to an objective category, and the other of destination points 28 corresponds to a subjective category. The player must answer a question corresponding to the indicia 30 contained on the selected destination point 28 and the first player to correctly answer a question while on the destination point 28 is deemed the winner.

In a 2-player game, it is desirable to use the predetermined answer printed on each of the subjective question cards 18 and 20, since the polling of the single opposing player would be adequate.

In the game apparatus of the present invention, the question cards 14, 16, 18 and 20 are written so that each of the questions on the cards asks questions which not only test the players knowledge, but provide educational information. Thus, when playing the game, the players not only enjoy the inherent competitive features of the game, but also acquire knowledge related to the subject matter of each card. While specific categories are shown in the preferred embodiment in the invention, other categories could be selected to broaden the scope of the game. Further, the pre-printed answers on the subjective question cards may be varied so as to reflect the opinions of various groups of people, e.g. people from certain geographic areas or people belonging to certain ethnic groups, etc.

One of the most enjoyable and interesting features of the board game apparatus of the present invention is the number of possible choices available to the players while playing the game. Since two separate objective question cards and two separate subjective question cards are always displayed, the players are able to choose which category to select. After hearing the question, the current player then has the option of answering the question, and possible having to move backward, or passing and staying on the same playing space. Allowing the player this large number of possible choices increases the enjoyment of the game and introduces strategic decisions into the play.

Although the board game of the present invention has been shown and described as including a pre-printed game board 10, it should be understood that the board game could be modified to be played electronically on a computer or across the internet while operating within the scope of the invention.

It is recognized that various equivalents, alternatives and modifications to the invention as described are possible. Such equivalents, alternatives and modifications should be considered to fall within the scope of the following claims.

I claim:

1. A board game apparatus for use by at least one player, comprising:

a game board having a plurality of playing spaces defining a course of travel extending from a starting space to at least one destination point, each playing space including one of a plurality of indicia;

a plurality of objective question cards each having an objective question and a predetermined answer, the objective question cards corresponding to one of the indicia;

a plurality of subjective question cards each having a subjective question and a plurality of possible answers, the subjective question cards corresponding to one of the indicia;

a plurality of playing members to be advanced along the plurality of playing spaces defining the course of travel;

means for use in advancing the playing members toward the destination point; and wherein upon reaching a playing space, either one of the objective question cards or one of the subjective question cards is selected based on the indicia included in the playing space and the player must correctly answer the question on the selected question card before advancing along the course of travel.

2. The board game of claim 1 wherein each of the plurality of objective question cards and subjective question cards includes a question selected from one of a plurality of categories, each of the objective question cards and subjective question cards having a label on a top face of the card describing the category of the question contained on the card.

3. The board game of claim 2 wherein the plurality of subjective question cards and the plurality of objective question cards are each divided into two decks such that the top face of two objective cards and the top face of two subjective cards are always exposed.

4. The board game of claim 1 wherein the plurality of playing spaces include at least one choice space that allows the player to select between the subjective question cards and the objective question cards.

5. The board game of claim 1 wherein the correct answer to the question on each of the subjective question cards is determined by taking a poll of the players.

6. The board game of claim 1 wherein the plurality of indicia are distinguished by color.

7. A board game apparatus for use by a plurality of players comprising:

a game board having a plurality of playing spaces defining a course of travel extending from a starting point to at least one destination point;

a plurality of objective question cards each having an objective question and a predetermined answer;

a plurality of subjective question cards each having a subjective question and a plurality of possible answers;

a plurality of playing members to be advanced along the course of travel, such that each player is represented by one of the playing members;

means for use in advancing the playing members toward the destination point;

wherein upon reaching a playing space, the player must correctly answer a question from either one of the objective question cards or one of the subjective question cards before advancing from the playing space.

8. The board game of claim 7 wherein each of the playing spaces includes one of a pair of indicia, each indicia corresponding to either the subjective question cards or the objective question cards, such that upon reaching a playing space, the selection of the question is determined by the indicia.

9. The board game of claim 7 further comprising a plurality of choice spaces positioned among the playing spaces along the course of travel, wherein upon a player landing on one of the choice spaces, a selection can be made between the objective question cards and the subjective question cards.

10. The board game of claim 7 wherein the correct answer to the question on each of the subjective question cards is determined by taking a poll of the players.

11. A method of playing a board game, comprising the steps of: providing a game set including:

a game board having a plurality of playing spaces defining a course of travel extending from a starting point to at least one destination point, each playing space including one of a plurality of indicia;

a plurality of objective question cards each having an objective question and a predetermined answer;

a plurality of subjective question cards each having a subjective question and a plurality of possible answers; and a plurality of playing members to be advanced along the course of travel;

advancing a playing member along the course of travel toward the destination point;

selecting one of the objective question cards or one of the subjective question cards based on the indicia contained in the playing space upon which the playing member rests;

asking the question from the selected question card to one of the players;

determining if the answer given by the player corresponds to the answer on the question card, such that if the answer given by the player is incorrect, the player retreats along the course of travel.

12. The method of claim 11 wherein the plurality of subjective question cards and the plurality of objective question cards each include two categories and the plurality of indicia identify the categories separately.

13. The method of claim 11 further comprising the step of polling the players to determine the correct answer when a subjective question card is selected.

14. The method of claim 11 wherein the game set further comprises a plurality of choice spaces positioned among the playing spaces along the course of travel, such that when a player lands on one of the choice spaces, the player can choose a question from either the objective question cards or the subjective question cards.

* * * * *